US005341087A

United States Patent [19]

Van Leeuwen

[11] Patent Number: 5,341,087

[45] Date of Patent: Aug. 23, 1994

[54] REFERENCE CURRENT LOOP

[75] Inventor: Gerrit H. Van Leeuwen, Eindhoven, Netherlands

[73] Assignee: U.S. Philips Corporation, New York, N.Y.

[21] Appl. No.: 977,331

[22] Filed: Nov. 17, 1992

[30] Foreign Application Priority Data

Nov. 25, 1991 [EP] European Pat. Off. ..... 91203074.9

[51] Int. Cl.[5] ..... G05F 3/26

[52] U.S. Cl. ..... 323/315; 323/316; 363/73

[58] Field of Search ..... 323/312, 315, 316, 317; 363/73; 307/296.1, 296.6

[56] References Cited

U.S. PATENT DOCUMENTS 4,388,539 6/1983 Boeke ..... 323/316 X
4,675,594 6/1987 Reinke ..... 323/317
4,717,869 1/1988 Koch et al. ..... 323/316
5,245,218 9/1993 Rinderle et al. ..... 363/73 X
5,266,887 11/1993 Smith ..... 323/316

*Primary Examiner*—Emanuel T. Voeltz
*Attorney, Agent, or Firm*—Robert J. Kraus

[57] ABSTRACT

Reference current loop comprising a group of identical ICs (1, 2, 3), comprising each a first impedance (7) connected in series to the first impedance of another IC of the group. The combination of first impedances is connected to a reference current source (4). The voltage across the first impedance (7) is convened to a current (I0) by a voltage-to-current converter (8) and made available as a current (I1, I2) proportional to the reference current (Iref) of the reference current source (4) by a current mirror circuit (20, 23). The relation between the currents I1 and I2 and the reference current Iref is determined by the ratio of the impedance value of the first impedance (7) to that of the second impedance (19). This ratio is the same for all the ICs, so that the currents I1 and I2 in all the ICs are mutually equal.

3 Claims, 1 Drawing Sheet

REFERENCE CURRENT LOOP

BACKGROUND OF THE INVENTION

The invention relates to a reference current loop. In electronics it regularly happens that a multiplicity of identical integrated circuits (ICs) are used for performing a specific electronic function. This is the case, for example, for series and parallel driver circuits for Liquid Crystal Displays (LCDs) accommodated in groups in a plurality of ICs. For a correct operation of the driver circuits the same quiescent current is required to flow through all the final stages of these driver circuits. Each IC comprises one or more final stages which may be fed with the same quiescent current with the aid of a current mirror circuit whose input current is determined by converting a known precise voltage to a current with the aid of a resistor or other impedance. The known precise voltage is distributed over all the ICs and is thus the same to all the ICs. Due to manufacturing tolerances in the resistor (or other impedance), the resultant input currents of the current minor circuits in the individual ICs are not equal. As a result, the quiescent currents in the final stages differ from one IC to the next and the input current is to be adjusted for each IC.

This tolerance problem generally occurs among groups of ICs, an important performance parameter being determined by the value of a current. It is an object of the invention to provide a solution for this tolerance problem.

SUMMARY OF THE INVENTION

According to the invention, a reference current loop is provided to this end, comprising:

- a reference current source;
- a group of at least two integrated circuits, comprising each:
  - a first and a second reference current terminal;
  - a first impedance connected to the first and second reference current terminals;
  - a second impedance of a similar type to the first impedance and having an impedance value that has a predetermined proportion to the impedance value of the first impedance;
  - a voltage-to-current converter including:
    - an input for receiving a voltage difference occurring between the first and second reference voltage terminals, and an output for supplying an output current which is a function of the impedance value of the second impedance;
  - a current mirror circuit comprising an input branch and at least one output branch, the input branch being coupled to the output of the voltage-to-current converter;

means for mutually coupling the respective first and second reference current terminals of the integrated circuits, the respective first impedances of the integrated circuits forming a series combination and means for coupling the reference current source to the series combination.

The invention is based on the understanding that all ICs are included in a closed current loop in which a reference current flows. This current which is equal to all ICs, is convened to a voltage in each IC with the aid of the first impedance which in a preferred embodiment is arranged as a resistor. In the voltage-to-current converter the voltage across the first impedance is convened to an output current whose magnitude is determined by the value of the second impedance, again preferably a resistor, and the voltage across the first impedance. The output current of the voltage-to-current converter is thus proportional to the ratio of the impedance value of the second to that of the first impedance. In IC technology the ratio of the values of two impedances, such as resistors, capacitors and transistor junctions, can be determined very accurately in the design of an IC. The magnitude of the output current of the voltage-to-current converter thus has a very accurate predeterminable relation to the magnitude of the reference current flowing in the reference current loop. The output current flows into the input branch of the current mirror circuit of which, as is known, the minor factor may also be determined very accurately in the design of an IC. The current flowing in the output branch or branches of the current minor circuit thus also has a value which has an accurately predeterminable relation to the reference current.

In this manner there is achieved that the currents in the output branches of the individual ICs are mutually substantially equal. These currents may be used as a quiescent current in the final stages of aforementioned LCD driver circuits. Naturally, they may also be utilized for any other type of application where a current-dependent performance parameter is concerned. For example, for multi-channel digital-to-analog conversion by way of a plurality of digital-to-analog converters accommodated in individual ICs and whose operation is based on the addition of currents which form a binary weighted series relative to a reference current.

The reference current loop according to the invention is further advantageous in that the current-dependent performance parameter of all the ICs in the loop may be varied by varying no more than a single current, i.e. the reference current. Individual preadjustments per IC are not necessary for providing proper tracking of the ICs.

The reference current source causes a voltage drop to occur across the first impedances. The absolute voltage on the first and second reference current terminals is thus different for each IC of the group. This may form a restriction to the number of ICs that may be connected in series in the reference current loop. For obviating this drawback an embodiment of a voltage-to-current converter according to the invention is characterized, in that the voltage-to-current converter comprises:

- a first and a second operational amplifier, having each an inverting input, a non-inverting input and an output, the non-inverting input of the first and the second operational amplifier respectively, being coupled to the first and the second reference voltage terminal respectively;
- a first and a second transistor, comprising each a control electrode, a first main electrode and a second main electrode, the control electrode of the first and the second transistor respectively, being coupled to the output of the first and second operational amplifier respectively, the first main electrode of the first and the second transistor respectively, being coupled to the inverting input of the first and the second operational amplifier respectively, and the first main electrodes of the first and the second transistor being mutually coupled by way of the second impedance, the input branch being connected in series to a current path formed by the first and second transistors and the second impedance.

This voltage-to-current converter in the reference current loop according to the invention is therefore arranged as a floating converter. Consequently, each IC may be incorporated in the loop at an arbitrary location. As a result, the output current of the voltage-to-current converter is also supplied from an absolute voltage which is different for each IC. By permitting this output current to flow through the input branch of the current mirror circuit, currents become available in the output branch or branches at an absolute voltage level which is equal for all the ICs.

The inputs of the operational amplifiers draw a negligible current and therefore hardly load the currents flowing through the first and second impedances. This achieves that especially the reference current is equal for all the ICs.

BRIEF DESCRIPTION OF THE DRAWING

The invention will now be further explained with reference to the annexed drawing in which.

In these drawing Figures elements or components having like functions have like reference numerals.

DESCRIPTION OF THE PREFERRED EMBODIMENTS

Figure 1:
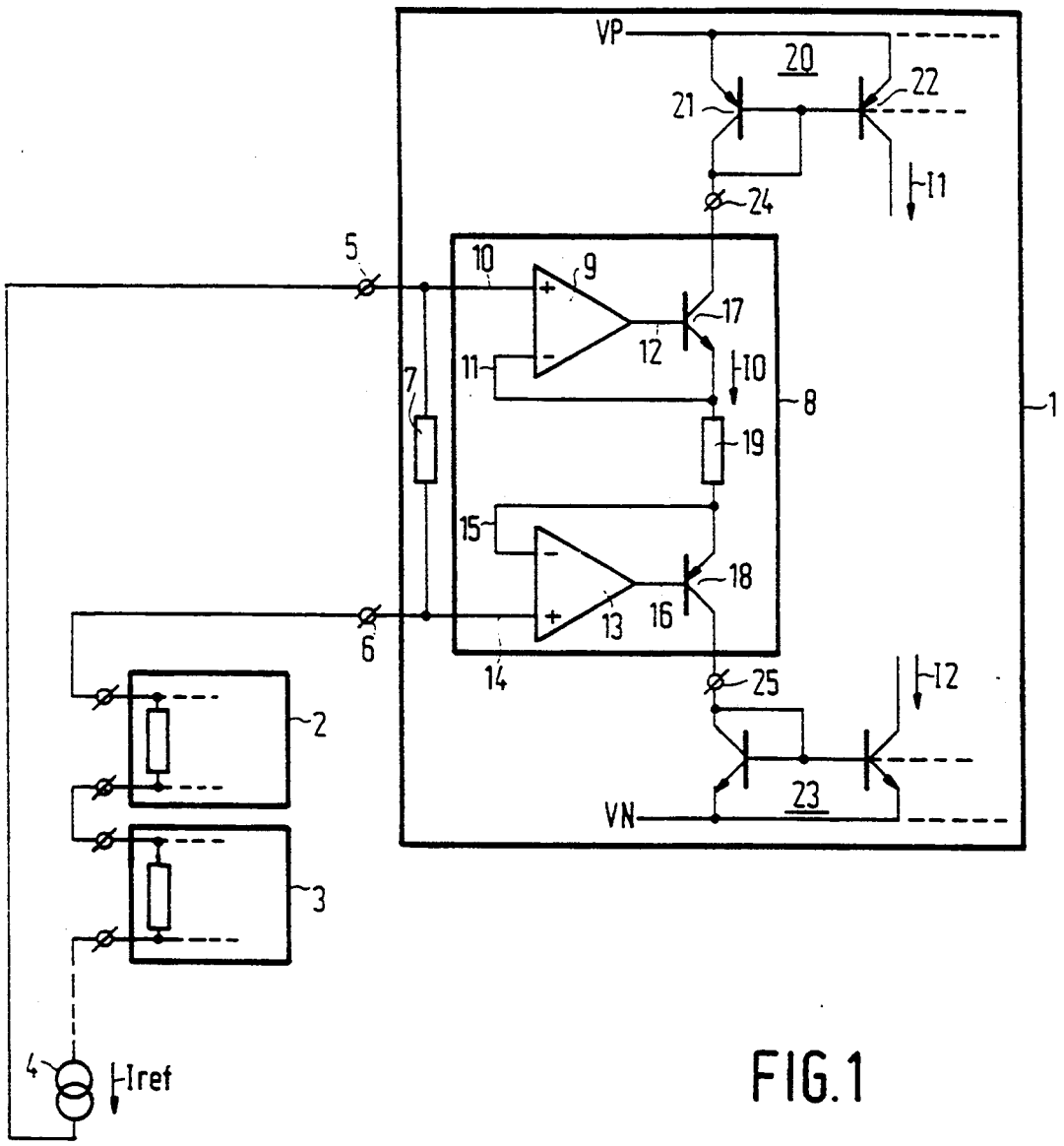
FIG. 1 shows an embodiment of a reference current loop according to the invention.

Drawing FIG. 1 shows an embodiment of a reference current loop according to the invention. The transistors shown are bipolar transistors of which the base corresponds to the control electrode, the emitter to the first main electrode and the collector to the second main electrode of the transistor. In lieu of bipolar transistors also unipolar transistors may be used, in which case the control electrode, the first main electrode and the second main electrode then correspond to the gate, source and drain respectively, of the unipolar transistor. The loop comprises a group of integrated circuits (ICs), three of which have been shown by way of example, referenced 1, 2 and 3 and a reference current source 4 which supplies a reference current Iref. Components germane to the explanation are shown in IC 1. The further ICs are identical with IC 1 and are shown only symbolically. IC 1 comprises a first reference current terminal 5 and a second reference current terminal 6. A first impedance 7 is connected across these reference current terminals 5 and 6. The impedance 7 is preferably a resistor, but a capacitor, a plurality of transistor junctions or a combination of said components, is also possible. IC 1 further includes a floating voltage-to-current converter 8 constituted by a first operational amplifier 9 which has a non-inverting input 10, an inverting input 11 and an output 12, by a second operational amplifier which has a non-inverting input 14, an inverting input 15 and an output 16, by a first NPN transistor 17, a second PNP transistor 18 and a second impedance 19 similar to impedance 7. The non-inverting inputs 10 and 14 are connected to the reference current terminals 5 and 6 respectively. The inverting inputs 11 and 15 are connected to the emitters of the respective first second transistors 17 and 18. The second impedance 19 is inserted between the emitters of the respective first and second transistors 17 and 18. The outputs 12 and 16 are connected to the bases of the respective first and second transistors 17 and 18, the collectors of which transistors forming the respective outputs 24 and 25 of the voltage-to-current converter 8.

IC 1 further includes a PNP current mirror circuit 20, whose input branch is constituted by a diode-arranged PNP transistor 21 and whose output branch is constituted by PNP transistor 22. The emitters of transistors 21 and 22 are connected to a positive voltage VP. The collector of the first transistor 17 is connected to the collector of transistor 21, so that the output current I0 of the voltage-to-current converter flows through the input branch of current minor circuit 20. The base-emitter junctions of transistors 21 and 22 are connected in parallel. Current minor circuit 20 produces a current I1 which may be tapped from the collector of transistor 22. No more than a single output branch of current minor circuit 20 is shown. Output branches may be added by means of more transistors connected similarly to transistor 22.

The collector of the second transistor 18 is connected to the input branch of an NPN current minor circuit 23 which is arranged in similar fashion to the current minor circuit 20 and whose output branch supplies a current I2. If so desired, either of the current minor circuits 20, 23 may be omitted. In that case the collector concerned of the first transistor 17 or of the second transistor 18 is to be connected to the positive voltage VP or the negative voltage VN.

The reference current Iref causes a voltage drop to occur across the first impedance 7 which voltage drop is convened by the voltage-to-current converter to an equally large voltage drop across the second impedance 19. The voltage difference between the inputs of the operational amplifiers 9 and 13 is small. The output current I0 of the voltage-to-current converter is proportional to Iref. The proportionality is determined by the ratio of the impedance value of the first impedance 7 to that of the second impedance 19. Since the ratio of impedance values can be determined accurately in IC technology, the ratio of the current I0 to the reference current Iref is also determined accurately. The mirror factors of the current mirror circuits 20 and 23 can, as is known, also be made very accurate. As a result, there is a very accurate relation between the currents I1 and Iref and between the currents I2 and Iref. If the ICs are identical, these relations will be equal for all the ICs, so that the current I1 and the current I2 are substantially equally large in all the ICs. By rendering the current Iref of the reference current source 4 variable, the currents I1 and I2 of all the ICs may be varied by means of a single adjustment.

The loop current Iref flows from one IC to the next. An IC is not to derive current from the loop current. This is achieved by utilizing operational amplifiers 9, 13 whose non-inverting inputs hardly load the reference current terminals 5 and 6.

The currents I1 and/or I2 may be used for all sons of purposes, for example, as a quiescent current for a final stage of a driver circuit of an LCD display or as a reference current for a digital-to-analog converter comprising current sources.

Figure 2:
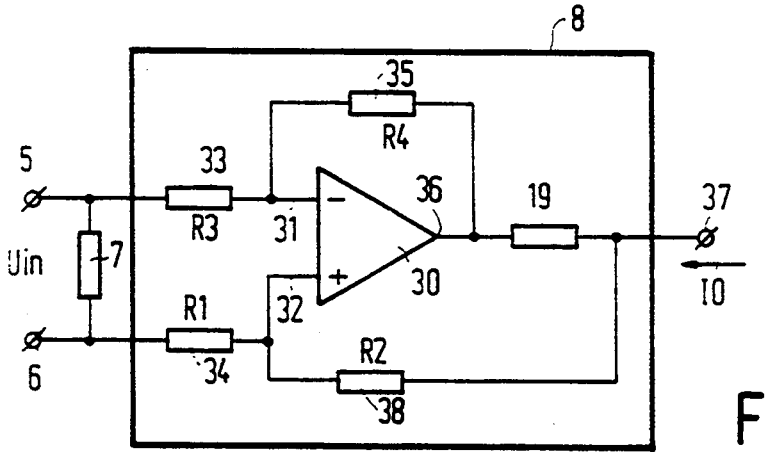
FIG. 2 shows an alternative voltage-to-current converter to be used in a reference current loop according to the invention.

Drawing FIG. 2 shows an alternative voltage-to-current converter 8. The inverting input 31 and the non-inverting input 32 of an operational amplifier 30 are connected by way of resistors 33 and 34 to the reference current terminals 5 and 6 respectively, across which the first impedance 7 is connected. The inverting input 31 is connected through a resistor 35 to the output 36 of the operational amplifier 30. The output 36 is further connected by way of the second impedance 19 to an output 37 which is connected to the non-inverting input 32 through a resistor 38. The output 37 applies the current IO to the input branch of a current mirror circuit (non shown). The resistors 34, 38, 33 and 35 have the respective values R1, R2, R3 and R4. The voltage across the first impedance (7) is Uin. If R2/R1=R4/R3, then IO=Uin/Z * R2/R1, where Z is the value of the second impedance 19. Thus the output current IO is a function of the input voltage Uin.

The invention is not restricted to the embodiment shown. Unipolar transistors may be substituted for either all or pan of the bipolar transistors. The current minor circuits 20 and 23 may be replaced by more advanced and more accurate current mirror circuits which are known per se from the literature.

I claim:

1. Reference current loop comprising:

a reference current source (4);

a group of at least two integrated circuits (1, 2, 3), each comprising:

a first (5) and a second (6) reference current terminal;

a first (7) impedance connected to the first (5) and second (6) reference current terminals;

a second impedance (19) of a similar type to the first impedance (7) and having an impedance value that has a predetermined proportion to the impedance value of the first impedance;

a voltage-to-current converter (8) including:

an input (10, 14) for receiving a voltage difference occurring between the first and second reference voltage terminals (5, 6), and an output (24, 25) for supplying an output current (IO) which is a function of the impedance value of the second impedance (19);

a current mirror circuit (20) comprising an input branch (21) and at least one output branch (22), the input branch (21) being coupled to the output (24) of the voltage-to-current converter (8);

means for mutually coupling the respective first (5) and second (6) reference current terminals of the integrated circuits (1, 2, 3), the respective first impedances (7) of the integrated circuits forming a series combination and means for coupling the reference current source (4) to the series combination.

2. Reference current loop as claimed in claim 1, characterized in that the voltage-to-current converter (8) comprises:

a first and a second operational amplifier (9, 13), having each an inverting input (11, 15), a non-inverting input (10, 14) and an output (12, 16), the non-inverting input (10, 14) of the first and the second operational amplifier (9, 13) respectively, being coupled to the first and the second reference voltage terminal (5, 6) respectively;

a first and a second transistor (17, 18), each comprising control electrode, a first main electrode and a second main electrode, the control electrode of the first and the second transistor (17, 18) respectively, being coupled to the output (12, 16) of the first and second operational amplifier (9, 13) respectively, the first main electrode of the first and the second transistor (17, 18) respectively, being coupled to the inverting input (11, 15) of the first and the second operational amplifier (9, 13) respectively, and the first main electrodes of the first and second transistors being mutually coupled by way of the second impedance (19), the input branch (21) being connected in series to a current path (IO) formed by the first and the second transistor (17, 18) and the second impedance (19).

3. Reference current loop as claimed in claim 1 or 2, characterized in that the first and the second impedances are resistors.

* * * * *